US009905352B2

(12) United States Patent
Cedell et al.

(10) Patent No.: US 9,905,352 B2
(45) Date of Patent: Feb. 27, 2018

(54) THERMAL MANAGEMENT SYSTEM FOR SMC INDUCTORS

(71) Applicant: MAGCOMP AB, Eslöv (SE)

(72) Inventors: Tord Cedell, Bjärred (SE); Öskar H. Bjarnasen, Hjärup (SE)

(73) Assignee: MAGCOMP AB, Eslöv (SE)

( * ) Notice: Subject to any disclaimer, the term of this patent is extended or adjusted under 35 U.S.C. 154(b) by 0 days.

(21) Appl. No.: 14/786,603

(22) PCT Filed: Apr. 23, 2014

(86) PCT No.: PCT/EP2014/058252
§ 371 (c)(1),
(2) Date: Oct. 23, 2015

(87) PCT Pub. No.: WO2014/173960
PCT Pub. Date: Oct. 30, 2014

(65) Prior Publication Data

US 2016/0078993 A1 Mar. 17, 2016

(30) Foreign Application Priority Data

Apr. 25, 2013 (EP) ..... 13165430

(51) Int. Cl.
*H01F 27/28* (2006.01)
*H01F 27/10* (2006.01)
(Continued)

(52) U.S. Cl.
CPC ..... *H01F 27/085* (2013.01); *H01F 27/10* (2013.01); *H01F 27/22* (2013.01); *H01F 27/255* (2013.01);
(Continued)

(58) Field of Classification Search
CPC ..... H01F 27/22; H01F 27/12; H01F 27/085; H01F 27/322; H01F 27/2876
(Continued)

(56) References Cited

U.S. PATENT DOCUMENTS 3,142,809 A * 7/1964 Remenyik ..... H01F 27/22 165/185
3,386,058 A * 5/1968 Michel ..... H01F 27/303 336/100
(Continued)

FOREIGN PATENT DOCUMENTS

CA 1210464 8/1986
CA 2793830 A1 * 9/2011 ..... H01F 27/255
(Continued)

OTHER PUBLICATIONS

"Atomet EM-1 Ferromagnetic Composite powder," found on the intemet at http://qmp-staging.openface.ca/rtecontent/document/ATOMET_EM1-Brochure.pdf, 2006.

*Primary Examiner* — Tsz Chan
(74) *Attorney, Agent, or Firm* — Capitol City TechLaw

(57) ABSTRACT

The invention relates to an inductor (1) having a coil (2) and a core (3), wherein the core (3) is made of a Soft Magnetic Composite (SMC), the coil (2) is composed of a annularly wound electrical conductor, the coil (2) is substantially integrated into said core (3) so that the core (3) material acts as a thermal conductor having thermal conductivity above 1.5 W/m*K more preferably 2 W/m*K most preferably 3 W/m*K, conducting heat from said coil (2), wherein the inductor (1) is in thermal connection with at least one thermal connecting fixture (10-25), wherein said at least one thermal connecting fixture (10-25) is adapted to be connected to a first external heat receiver (4) so as to conduct heat from the inductor to said first external heat receiver (4).

7 Claims, 10 Drawing Sheets

(51) Int. Cl.
*H01F 27/02* (2006.01)
*H01F 27/08* (2006.01)
*H01F 27/22* (2006.01)
*H01F 27/255* (2006.01)

(52) U.S. Cl.
CPC ..... *H01F 27/2823* (2013.01); *H01F 27/2876* (2013.01)

(58) Field of Classification Search
USPC ..... 336/55, 57, 58, 59, 60, 61, 62
See application file for complete search history.

(56) References Cited

U.S. PATENT DOCUMENTS 3,414,698 A * 12/1968 Bedford ..... F24H 1/105 219/630
4,317,979 A * 3/1982 Frank ..... H01F 38/28 219/632
5,210,513 A 5/1993 Khan et al.
6,377,151 B1 * 4/2002 Takayama ..... H01F 17/045 336/192
6,392,519 B1 5/2002 Ronning
6,578,253 B1 6/2003 Herbert
6,900,420 B2 * 5/2005 Markegård ..... H05B 6/74 100/328
2004/0246084 A1 * 12/2004 Matsutani ..... H01F 17/04 336/5
2007/0295715 A1 * 12/2007 Saka ..... H01F 27/22 219/624
2011/0227680 A1 * 9/2011 MacLennan ..... H01F 27/06 336/55
2011/0304421 A1 12/2011 Chang
2012/0313740 A1 * 12/2012 Inaba ..... H01F 37/00 336/61

FOREIGN PATENT DOCUMENTS

EP 2230675 A2 9/2010
EP 2551863 A1 1/2013
EP 2709118 A1 3/2014
JP 2008112818 A * 5/2008
JP 2008198981 A * 8/2008
JP 2010212632 A * 9/2010
JP 2012209324 A * 10/2012

* cited by examiner

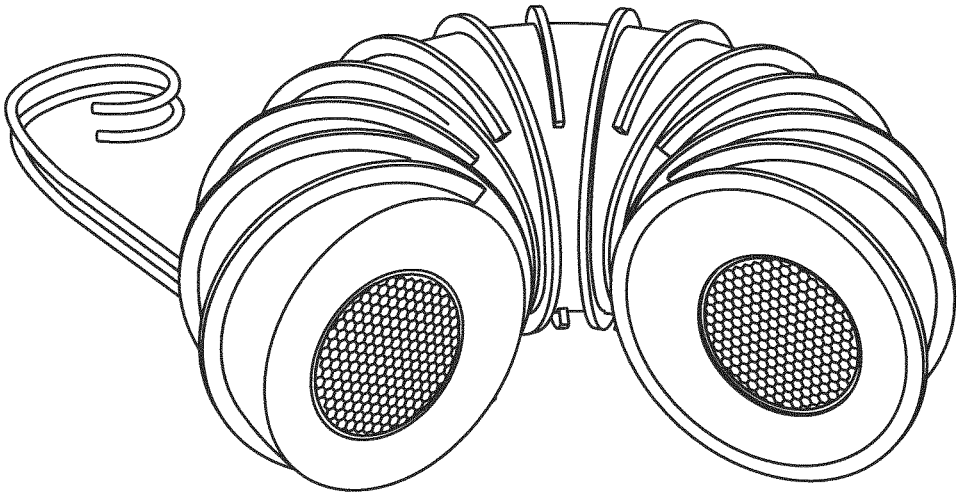
(Prior art) Fig. 12

THERMAL MANAGEMENT SYSTEM FOR SMC INDUCTORS

This application claims priority under 35 USC 119(a)-(d) to EP 13165430.3, which was filed on Apr. 25, 2013, the entire content of which is incorporated herein by reference.

TECHNICAL FIELD

The present invention relates generally to soft magnetic mouldable material inductors made with a thermal management system for effective cooling. More particularly, the present invention relates to a system to cool such inductors regardless of energy content while maintaining high efficiency. The system, depending on energy content, also has numerous other technical benefits such as for example resulting in substantially smaller units, more compact designs, and simplified mounting set up.

BACKGROUND ART

As both frequencies increase and energy content grows in inductors they are usually produced using e.g. 1) laminated steel plates with different thicknesses i.e. 0.5 mm 0.35 mm, 0.22 mm, 0.10 mm, depending on frequencies, 2) amorphous magnetic material, 3) sintered ferrite or pressed Soft magnetic composite (SMC) materials made into E, C or U shaped cores or I or toroid shaped cores, which can be glued together to make larger units and pot cores. A common problem with all these technologies is that introducing effective liquid cooling into their structure results in considerable mechanical challenges. Liquid cooling technologies usually entail numerous connecting points creating leakage risks as well as additional production steps. Another problem is that cooling both the conducting wire and the core material simultaneously with known and simple methods such as using planar liquid or air cooled heat sinks is very challenging or impossible. Furthermore, due to the fact that these units are produced from standard core materials the possibilities for optimization are limited. Also, due to challenges in production, some shapes made from pressed materials are not available above certain sizes. Additionally, inductors made with said technologies do not have a direct thermal connection between the core and coil material and their mechanical structure is such, making it impossible to create fully thermally homogenous designs. This creates inefficiencies and weaknesses in the inductor's structure.

The main technical challenge with inductors that have the coil encapsulated within their structure, e.g. pot cores or soft magnetic mouldable material cores, is that the resistive and high frequency related losses stemming from the coil are encapsulated within the inductor's structure. Higher temperature in turn increases the conductor's resistivity affecting its temperature and losses further. High frequencies also give rise to skin—and proximity effect within the coil, increasing temperature and losses in the coil even further.

Coils which are encapsulated within traditional pot cores are usually wound on standard bobbins. As such bobbins usually have very low thermal conductivity this creates a thermal barrier towards the top, bottom and centrum within such inductors. Pot cores are either made into half open cores to allow air cooling of the coil or they are open where the connecting cables come out. In the latter case they are usually filled with thermally conductive polymer based materials to obtain better thermal properties compared to only air. However, thermal properties of such materials are always relatively low in thermal conductivity usually not exceeding 1.5 W/m*K.

Other thermally motivated inductor designs include using aluminum housing for the inductors which are subsequently filled with similar thermally conductive polymer based material as described above. Such inductor designs include C-, U- or E cores, based on different core materials, where the coil is wound on a standard bobbin and subsequently placed between two cores, which usually have discrete air gap in between. The coil or the core is then placed against the aluminum housing which is usually mounted on or connected to a heat sink. Some of such designs also include the inclusion of cooling pipes for water cooling. The problem with these designs is the same as described above. They are not thermally homogeneous in their design. There is no direct thermal coupling between the coil and the core material allowing thermal conduction. The thermally conductive "potting material" has relatively low thermally conductive properties. There is only the possibility of placing either the coil or the core material against the housing/cooling. If such inductors are liquid cooled, this entails complicated mechanical challenges to effectively implement such cooling into their structure. Liquid cooling would further usually call for numerous connecting points creating leakage risks as well as additional production steps. An additional and important drawback is the need for the additional and costly aluminum housing and potting material around the inductor which also adds weight and takes more space within the further technical product.

It becomes particularly important for inductors that have the coil encapsulated within their structure, i.e. pot cores or soft magnetic mouldable material cores, to apply a system that secures the possibility of making inductors that do not run to hot i.e. a system that extracts the heat generated by the losses created in the conducting wire in the most efficient way. If this is not done the units become overly large, heavy and costly. In some cases, i.e. above certain energy content, such inductors become practically impossible to make using the current state of art.

SUMMARY OF THE INVENTION

Depending on energy content the below described embodiments are included in the claimed invention. External factors such as ambient temperature, surrounding air flow strength as well as current content contained in the switching frequencies, ripple or harmonics affects the demarcation of the different levels of the system and may cause them to overlap in applicability. Embodiments in the claimed invention are however in the correct order of applicability in correlation to increased energy content but external factors can also affect the feasibility of each method such as cost, efficiency requirement, space limitations, and the preferred cooling method and materials in the further technical product.

It is an object of the present invention to improve the current state of the art, to solve the above-mentioned problems, and to provide an improved inductor having enhanced cooling. These and other objects are achieved by an inductor having a coil and a core, wherein the core is made of a Soft Magnetic Composite (SMC), preferably of a sub-group containing soft magnetic mouldable material, the coil is composed of a annularly wound electrical conductor, the coil is substantially integrated into said core so that the core material acts as a thermal conductor having thermal conductivity above 1.5 W/m*K more preferably 2 W/m*K most preferably 3 W/m*K, conducting heat from said coil, wherein the inductor is in thermal connection with at least one thermal connecting fixture, wherein said at least one thermal connecting fixture is adapted to be connected to a first external heat receiver so as to conduct heat from the inductor to said first external heat receiver. The thermal connecting fixture is a heat conducting structure adapted to be used to conduct heat from the inductor to the external heat receiver. The thermal connecting fixture may also, as an extra feature, be used to fasten the inductor and e.g. have threads for mounting to the external heat receiver. The external heat receiver may be a traditional heat sink, a heat conducting mounting plate adapted to be connected to a heat sink, a water cooling block, a heat conductor leading the heat away etc. The term thermal connection should be interpreted as a tight connection so that heat is transferred from the inductor core and/or coil to the thermal connecting fixture. To ensure good heat transfer between the inductor and the first external heat receiver, a heat transferring paste may be placed between the surface of the first external heat receiver and the inductor and/or thermal connecting fixture so facilitate a good heat conduction to the first external heat receiver. A second reason to use heat transferring paste is that the paste also reduces the transfer of vibrations from the inductor that may arise from the alternating current and magnetic field in the inductor.

Since the coil is integrated into the core, the coil will have an excellent thermal connection to the core so that the core may conduct heat from the coil to e.g. the at least one thermal connecting fixture or directly to the heat receiver. To optimize transfer of heat generated in the coil, it is important that the coil has good heat conduction in the radial direction of the coil so that heat is conducted to the core and/or thermal connecting fixtures. I.e. the heat conduction should be high between the wires of the coil. It is further important that the electrical insulation, which is needed between the coil and the core, has as good heat conduction as possible so that heat is efficiently conducted from the coil to the core and/or the at least one thermal connecting fixture.

By the invention the inductor can be effectively cooled and the disadvantages of the prior art is reduced or avoided. As the thermal connecting fixture leads off heat efficiently, the inductor may be made smaller in size and used in smaller compartments closer to other equipment.

It is further preferred that the at least one thermal connecting fixture is moulded into said core, to optimize the thermal connection between the thermal connecting fixture and the inductor core to in turn optimize the heat conduction to the external heat receiver.

It is further preferred that the core has a shape that is adapted to enlarge the thermal connection surface between at least the bottom side of the inductor and adjusted to be placed on a flat surface of a heat receiver, wherein the diameter of the inductor is approximately at least two times the height. By having a flattened inductor, compared to the optimal torus shape, and by adapting the bottom side of the inductor so that it may have an optimal thermal connection to the external heat receiver, heat conduction from the inductor to the heat receiver is further enhanced.

According to one aspect of the invention, the thermal connecting fixture is or has a centrally detachable mounted screw/rod protruding through the centre the inductor along a central axis of the inductor. Since the inductor is "doughnut" shaped and normally has a void along the centre axis, the "hole" in the "doughnut" may be used to both fasten the inductor by e.g. a pole or screw through the hole. By facilitating a thermal connection between the screw/rod and the inductor and by having the screw in thermal connection with the external heat receiver, the inductor will be cooled by the screw/rod. The screw rod, is preferably fastened in the external heat receiver, pressing the inductor against the external heat receiver.

The thermal connecting fixture may also be a structure filling out the hole in the centre of the inductor, so that it has thermal connection to the inductor core and/or coil. A screw/rod may then be placed in the middle of the thermal connecting fixture to fasten and press the inductor and thermal connecting fixture to the first external heat receiver.

The thermal connecting fixture is preferably shaped after the magnetic field along the central axis of the inductor, e.g. in an hour glass shape, to reduce negative effects on the inductor's magnetic field. The hour glass is preferably adapted to receive a screw/rod in the centre to fasten and press the inductor and thermal connecting fixture to the first external heat receiver.

According to a further aspect of the invention, the at least one thermal connecting fixture is integrated in said core, being in thermal connection to said coil. As heat is generated by the coil, a direct thermal connection to the coil will more effectively lead away heat. Heat reduction is thereby further enhanced, leading to the possibility to build smaller inductors and/or use higher energy content in the inductor without over-heating the inductor. The thermal connectors may e.g. be moulded into the core so that they are in contact with the coil.

It is further preferred that the inductor has multiple thermal connecting fixtures at evenly spaced positions annular around said coil. The fixtures may conduct heat from the coil all around the coil, optimizing the heat reduction in the coil per connection area to the coil.

It is still further preferred that the thermal connecting fixtures are thin in the tangential direction of the coil so as to present a small cross section to the magnetic field of said coil. The thermal connecting fixtures may e.g. be cut out parts from a metal sheet, moulded into the core, directed towards the centre of the inductor. In that way negative effects on the inductor magnetic properties are reduced.

According to a further aspect of the invention, the at least one thermal connecting fixtures are in thermal connection to a second external heat receiver. The second external heat receiver is preferably placed on the upper side of the inductor to have a large thermal connection area to the inductor. The thermal connecting fixtures are then in thermal connection to both the first and second external heat receivers.

The at least one thermal connecting fixture is further preferably adapted to be attached to said first external heat receiver and thereby press the inductor against said first external heat receiver. The thermal connecting fixtures thereby fixate very simply the inductor, conducting heat from the inductor, and increasing and ensuring a good thermal connection between the external heat receiver or the external heat receivers and the inductor.

According to a further aspect of the invention, the thermal connecting fixtures are integral parts of said first and/or second external heat receiver, said heat receiver/receivers being an external heat sink or a cooling/mounting plate. The thermal connecting fixtures may be protrusions from the external heat receiver onto which the core is moulded or mounted. The thermal connection between the thermal connecting fixtures and the external heat receiver is then as good as it can be, as they are integrated. The amount of work for assembling the inductor is also reduced.

According to a still further aspect of the invention at least one of the connector cables of the inductor are cooled adjacent to their entry into the core material by thermal connection of a cooling device. This may be facilitated e.g. by a heat sink, air- or liquid cooling etc. As the connector cables are extensions of the coil and conducting wire usually has exceptional thermal conduction properties, the cooling may be efficient. For high power inductors, the turns of the coil are fewer and the wire thicker and thus are also the connector cables thicker (having a larger cross sectional area). Cooling the connector cables is thus more efficient for high power inductors.

According to a still further aspect of the present invention, the core has at least one integrated cooling pipe acting as thermal conducting fixtures wherein said cooling pipe/pipes are in thermal connection with said coil and said cooling pipe/pipes are adapted to accommodate a flow of a fluid for transporting heat from said coil towards an external cooler i.e. an external heat receiver. The fluid may e.g. be a liquid cooling medium. Liquid cooling is very efficient with the drawbacks of the necessity of pipes, a pump and the risk of leakage.

It is further preferred that the cooling pipes are wound in a spiral toroid shape around said annularly wound coil, to get a large thermal contact area to the coil. Winding cooling pipes around the coil facilitates cooling at the source of heat, i.e. the coil, and is a relatively simple production step making the production of the cooled inductor cheap. As the core is moulded around the coil, the production with regard to the core is not much effected.

According to a further aspect of the invention the coil has at least one integrated cooling pipe said cooling pipe/pipes being placed in the centre of the coil cross section. By integrating the cooling in the coil, the cooling is much more efficient, although the disturbance on the magnetic properties of the inductor are larger. For very high power inductors, however, the heat in the centre of the coil may be severe, and a cooling channel in the centre may therefore be very efficient and even beneficial since problems of saturation of the core material is reduced with the introduced voids of the pipe/pipes.

According to a further aspect of the invention the core has a shape that is adapted to enlarge the thermal connection surface between the upper sides of the inductor and a surface of a second heat receiver, wherein the thermal connecting fixtures may be thermally connected to said second heat receiver in analogous ways as to the first external heat receiver as described above. A second external heat receiver will further increase the cooling of the inductor and is thus preferable for large inductors in need of extra cooling.

When the two external heat receivers are present it is preferred that the connector cables of the inductor exit the core on the side, so as to not interfere with heat receivers attached to the upper and bottom sides.

According to a still further aspect of the invention, the at least one thermally connecting fixture is or is a part of a surface or cavity of a further technical product, wherein the core is moulded onto or into said surface or cavity. The product could be a mounting board for electronics, etc. By moulding the core of the inductor onto or into the thermal connecting fixture, the thermal connection will be good. As the thermal connecting fixture, e.g. a cavity, is part of the product where the inductor is to be finally used, a further assembly step is deducted making the manufacturing of the product cheaper at the same time as the heating problem is efficiently solved in accordance with the present inventive concept.

In one aspect of the invention it is further preferred that the thermal connecting fixtures, for all aspects of the invention described above, are adapted to position said coil during moulding of said core. In that way the fixation during moulding is solved at the same time as a good thermal connection between the coil and the thermal connecting fixtures are facilitated. Naturally, the coil is electrically insulated from the thermal connecting fixtures by a thin insulation that preferably has good heat conduction.

According to further aspect of the invention the inductor is a choke for a switching frequency above 2 kHz, more preferably above 4 kHz, most preferably above 6 kHz. The inductor is further preferably used at a energy contents above 0.2 J.

Generally, all terms used in the claims are to be interpreted according to their ordinary meaning in the technical field, unless explicitly defined otherwise herein. All references to "a/an/the [element, device, component, means, step, etc.]" are to be interpreted openly as referring to at least one instance of said element, device, component, means, step, etc., unless explicitly stated otherwise.

BRIEF DESCRIPTION OF THE DRAWINGS

The above objects, as well as additional objects, features and advantages of the present invention, will be more fully appreciated by reference to the following illustrative and non-limiting detailed description of preferred embodiments of the present invention, when taken in conjunction with the accompanying drawings, wherein.

FIG. **4*a*** is a perspective view of an inductor of the present invention where the thermal connecting fixture is a composed by multiple heat conductors in direct connection with the coil and a adapted to be received in thermal connection with a bottom first external heat receiver. The heat conductors are shaped thin in the tangential direction of the coil to present a small cross section to the magnetic field from the coil.

Figure 4A:
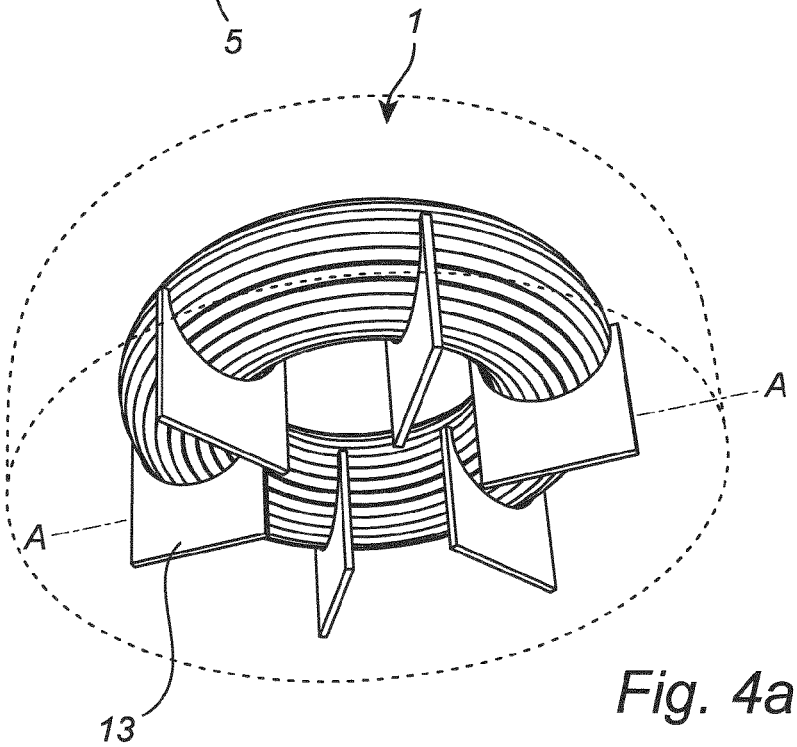

FIG. **4*b* is a cross sectional view of the embodiment of FIG. 4*a***, with the alteration that the coil has a rectangular cross section instead of a circular cross section.

FIG. **5*a*** is a perspective view of an inductor of the present invention where the thermal connecting fixture is a composed by multiple heat conductors in direct connection with the coil and a adapted to be received in thermal connection with a bottom first external heat receiver. The heat conductors are shaped thin in the tangential direction of the coil to present a small cross section to the magnetic field from the coil. The heat conductors are directed both downwards and to the sides if the inductor. The core, which is not shown, is later moulded around the coil and heat conductors/thermal connecting fixture.

Figure 5A:
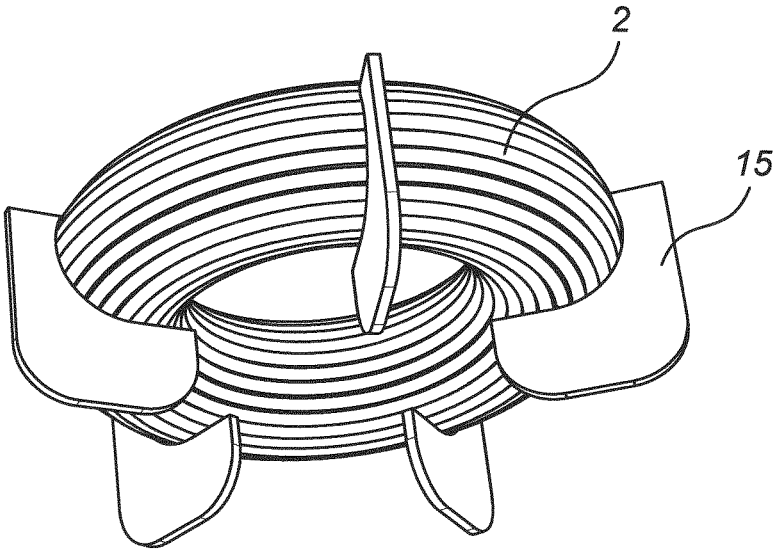
Figure 5B:
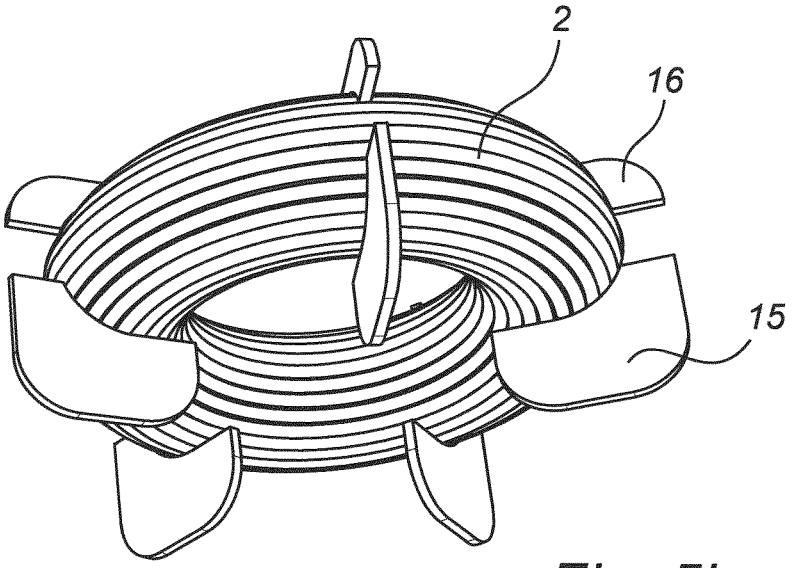

FIG. 5*b* is a perspective view of the embodiment of FIG. 5*a*, with the addition of a heat conductor conducting heat upwards to adapted to be received by an upper second external heat receiver.

Figure 5C:
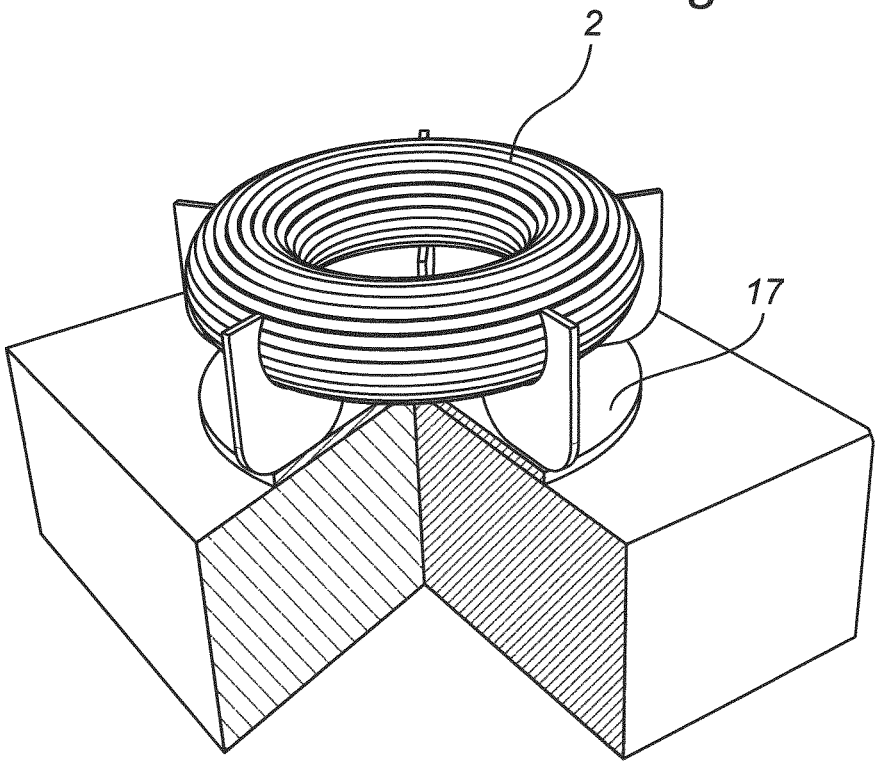

FIG. 5*c* is a perspective view of the embodiment of FIG. 5*a* wherein the heat conductors are in thermal connection with a bottom first external heat receiver and adapted to be integrated into the core. The core, which is not shown, is later moulded around the coil and heat conductors/thermal connecting fixture.

Figure 6:
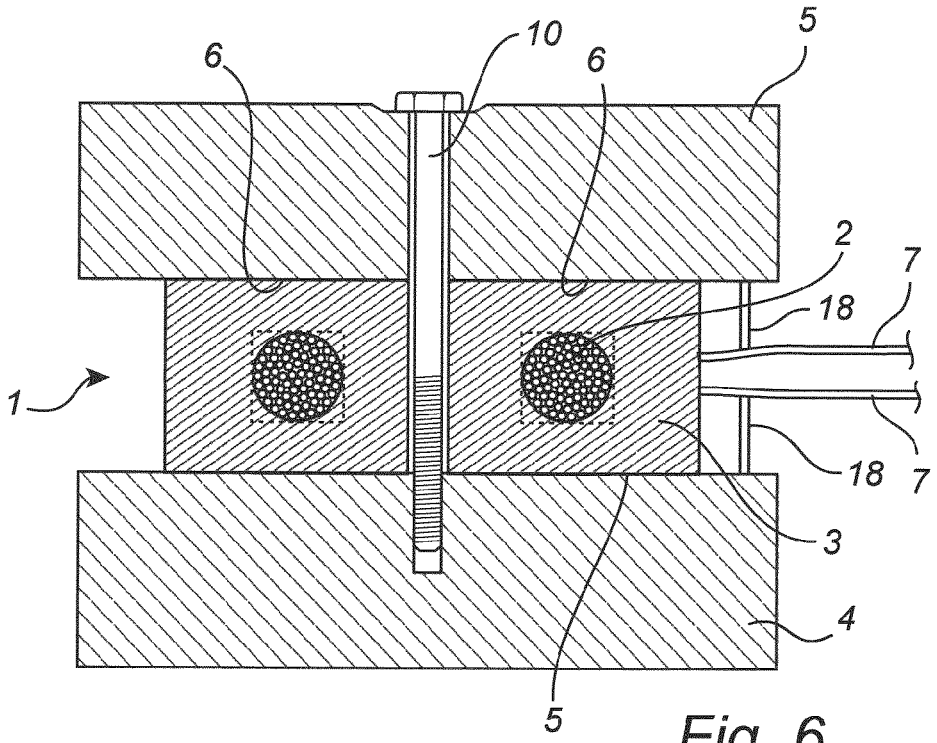

FIG. 6 is a cross sectional view of an inductor of the present invention where the thermal connecting fixtures are heat conductors attached to the connector cables of the inductor leading heat from the connector cables to the first and second external heat receivers. The inductor is fastened to the external heat receivers with central screw, the screw also being a thermal connecting fixture conducting heat to the heat receivers.

Figure 7A:
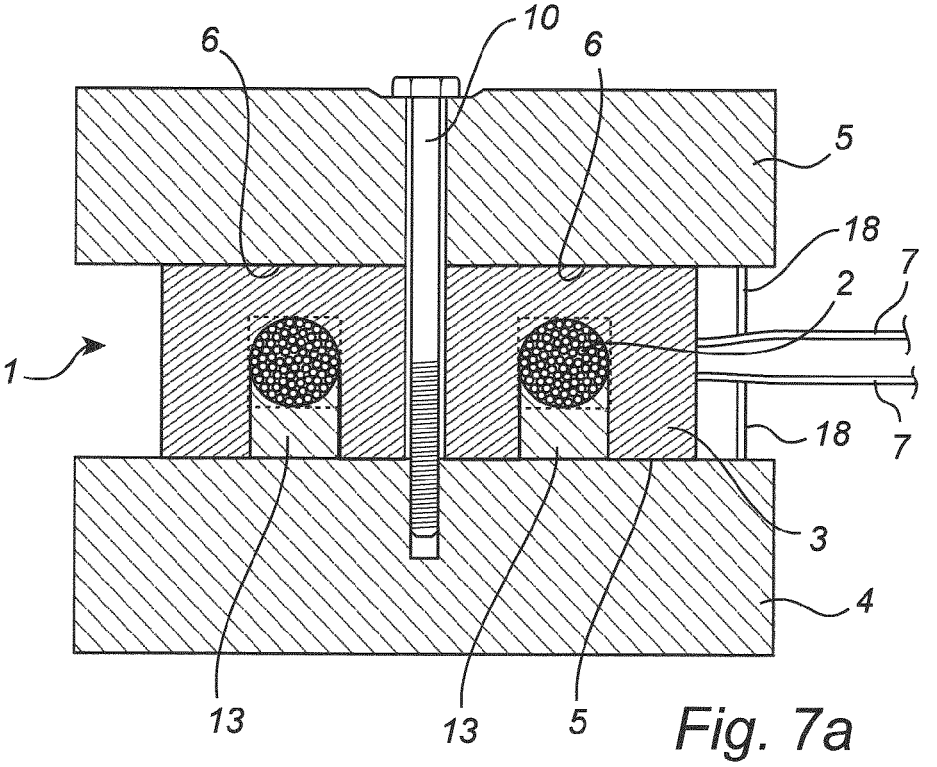

FIG. 7*a* is a cross sectional view of an inductor of the present invention where the thermal connecting fixtures are heat conductors attached to the connector cables of the inductor leading heat from the connector cables to the first and second external heat receivers. The inductor is fastened to the external heat receivers with central screw, the screw also being a thermal connecting fixture conducting heat to the heat receivers. The inductor further has annularly evenly placed thermal conductors, as in FIG. 4*a*, thermally connecting the coil to the bottom/first external heat receiver.

Figure 7B:
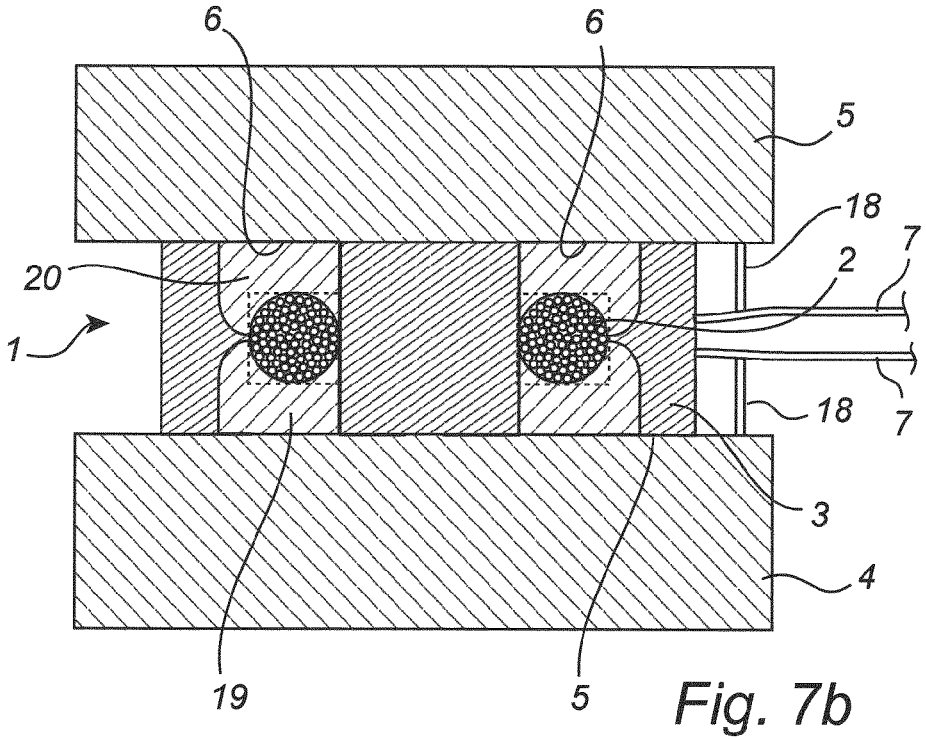

FIG. 7*b* is a cross sectional view of the inductor according to FIG. 7*a* without the screw, with thermal connectors that thermally connects the coil to both the bottom/first and the upper/second heat receivers.

Figure 7C:
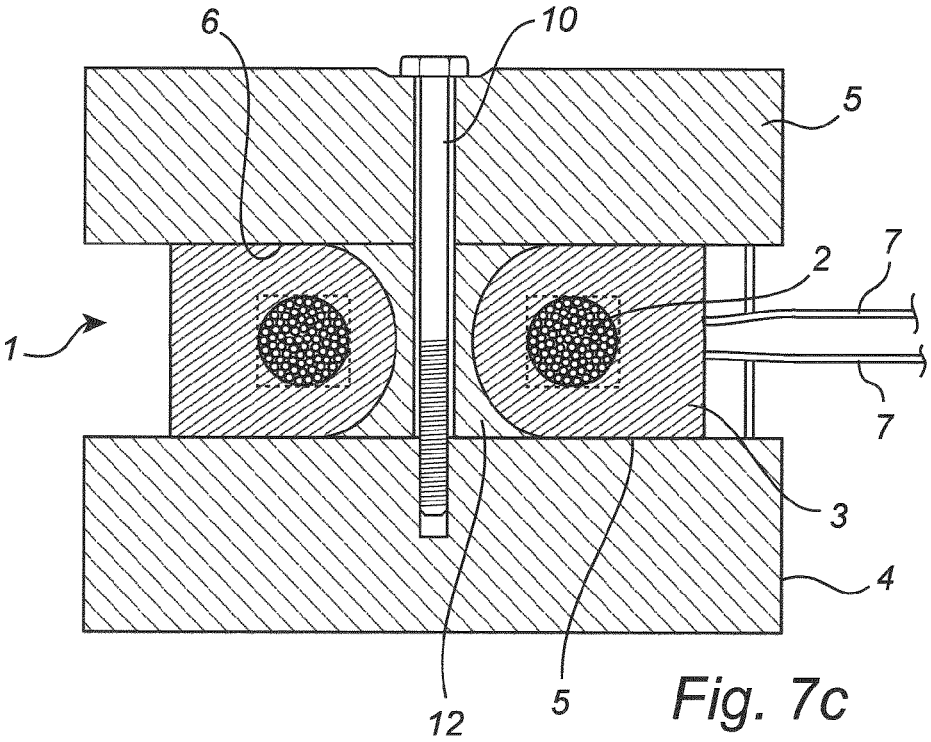

FIG. 7*c* is a cross sectional view of an inductor of the present invention where the thermal connecting fixtures are heat conductors attached to the connector cables of the inductor leading heat from the connector cables to the first and second external heat receivers. The inductor is fastened to the external heat receivers with central screw through a centrally placed heat conductor, centrally placed heat conductor conducting heat to the heat receivers.

Figure 7D:
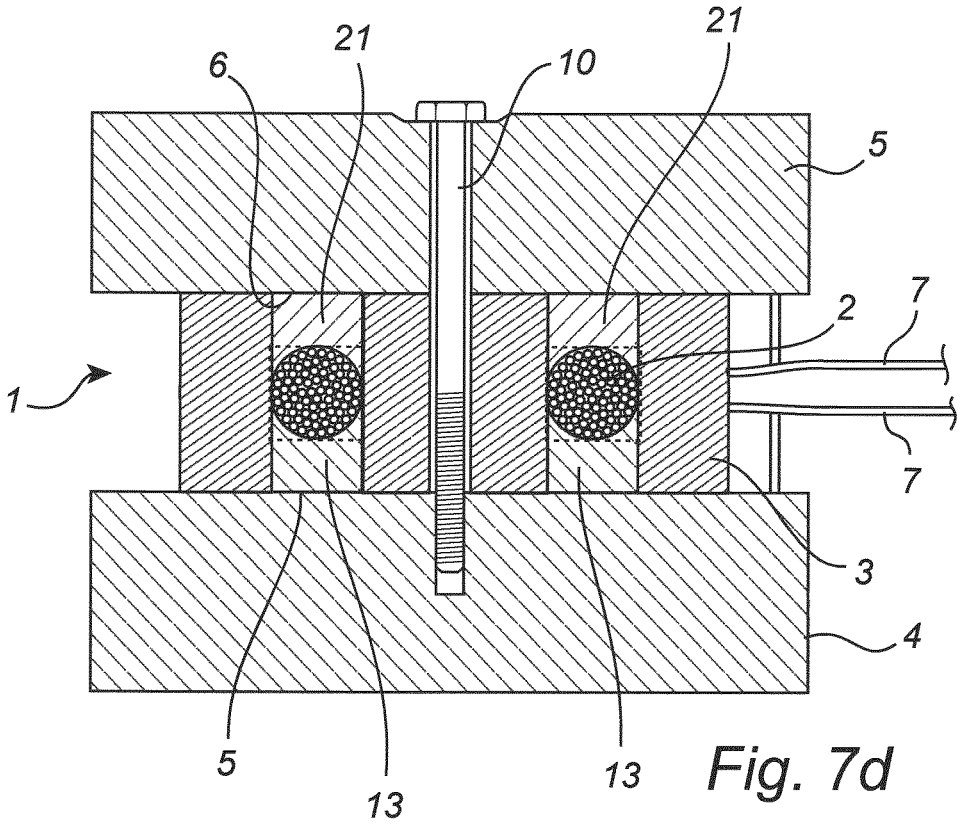

FIG. 7*d* is a cross sectional view of the inductor according to FIG. 7*a* with heat conductors also between the coil and the upper/second heat receiver.

Figure 8:
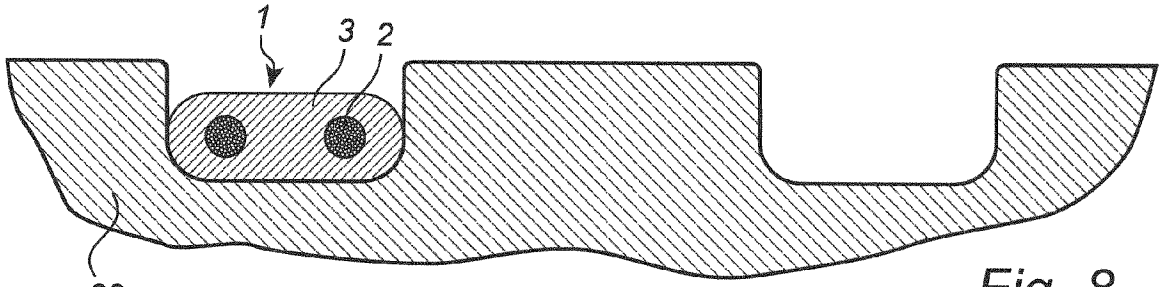

FIG. 8 is a cross sectional view of an inductor of the present invention where the thermal connecting fixture is the product into which the inductor is moulded/placed.

Figure 9A:
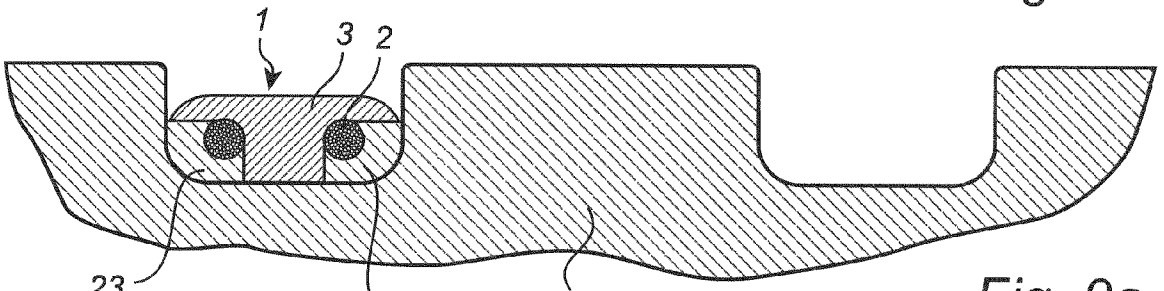

FIG. 9*a* is a cross sectional view of an inductor of the present invention where the thermal connecting fixture is the product into which the inductor is moulded/placed and where further thermal connecting fixture are present in the form of annularly evenly placed heat conductors, as in FIG. 4*a*, in thermal connection with the coil and the thermal connecting fixture being the product.

Figure 9B:
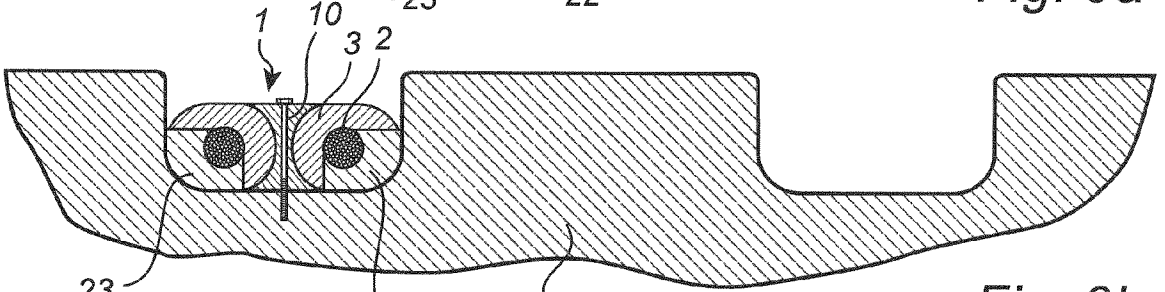

FIG. 9*b* is a cross sectional view of the inductor according to FIG. 9*a*, with a centrally placed screw for fastening the inductor and conduct heat from the centre of the inductor.

Figure 10:
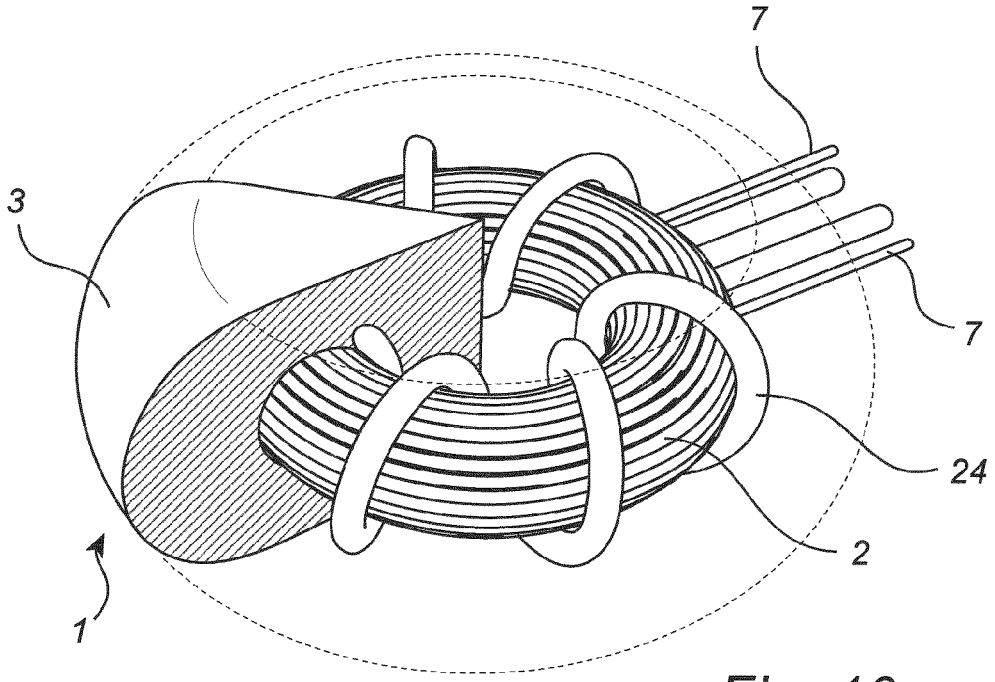

FIG. 10 is a perspective cut out view of an inductor having a cooling pipe for a fluid around the coil.

Figure 11:
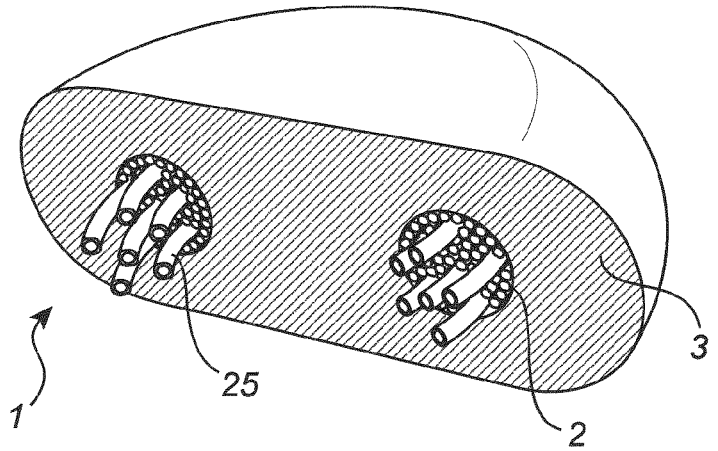

FIG. 11 is a perspective cut out view of an inductor having cooling pipes for fluid running inside the coil.

FIG. 12 is a cut out perspective view of an optimal inductor according to the prior art.

DETAILED DESCRIPTION OF PREFERRED EMBODIMENTS OF THE INVENTION

Figure 1:
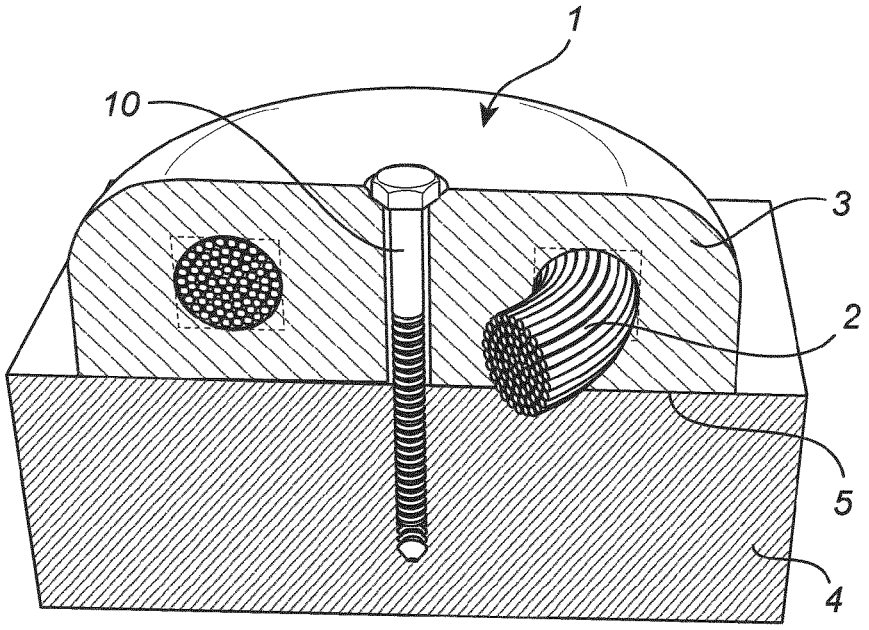
FIG. 1 is a cut out perspective view of an inductor of the present invention where the thermal connecting fixture is a screw in the centre of the inductor conducting heat to an external heat receiver and pressing the inductor towards the external heat receiver.

Embodiment One with Reference to FIG. 1

When the energy content reaches a certain point it becomes problematic to create inductive components with integrated coils due to over-heating of the conducting wire leading to drastically decreased efficiency, decreased life time of the insulation materials or insulation material breakdown.

In such cases, the present invention includes the first embodiment of using a soft magnetic mouldable material, embedding the annularly wound coil 2 completely in the core 3 material which has thermal conductivity above 1.5 W/m*K more preferable above 2 W/m*K, most preferable above 3 W/m*K, creating a direct thermal coupling between the coil and core material, the core material acting as a thermal conductor conducting heat from said coil 2. The first embodiment further includes adjusting the shape of the bottom surface area 5 of the soft magnetic mouldable material, increasing the core's surface into a circular shape so it can have thermal contact with larger cooling area. The otherwise optimal core 3 shape is a toroidal shape, following the magnetic flux generated by the coil, which saves material/cost, reduces weight and space (as explained in patent application EP12184479.9 and depicted in prior art FIG. 12). Further, the inductor 1 is shaped to have a larger diameter than height, preferably approximately equal to or more than twice the diameter compared to its height. This makes cooling from the bottom side 5 of the inductor very preferable due to the short distance from the centrum of the coil's hot spot to the inductor's outer surface.

The bottom surface 5 of the inductor is placed on an external heat receiver 4 which is made from a highly thermally conductive material which does not cause, or causes negligible, induction heating effects. This could be either a non-magnetic material or a magnetic material with low electrical conductivity.

Optimally the bottom surface 5 of the inductor 1 should be completely planar, with low surface roughness, so as to achieve a direct thermal coupling to the external heat receiver 4, 17 which the inductor is to be mounted on. This external heat receiver can for example be a mounting plate 17 or a heat sink 4, preferably made from aluminum or aluminum oxide, and can be either air or liquid cooled. The external heat receiver's 4, 17 surface should also be completely planar. This direct thermal coupling with an external heat receiver 4 maximizes heat transfer from the inductor to said external heat receiver. To secure said direct thermal coupling, over the complete surface area of the inductor 1 it shall optimally be pressed towards the external heat receiver. This can easily be achieved by first creating a cavity/hole in the centre of the core 3. A thermally conducting mounting screw 10, which acts as a thermal connecting fixture, is then inserted through the cavity/hole and into the external heat receiver and tightened with sufficient torque so as to secure that the two surfaces are substantially in direct contact (see FIG. 1). This single mounting screw 10 also enables quick and simple assembly. To even further secure the good heat conduction properties between the inductor and the cooling body, a heat transferring paste can be placed in between the surfaces. An additional benefit with such an addition is to reduce or remove vibrations created from the alternating current in the inductor.

Figure 2:
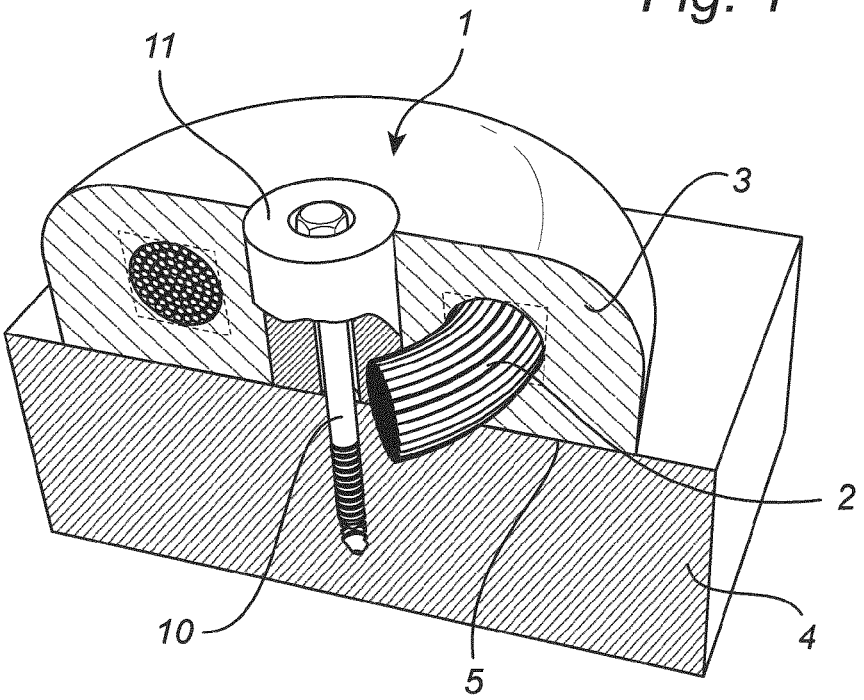
FIG. 2 is a cut out perspective view of an inductor of the present invention where the thermal connecting fixture is composed by a screw and a central heat conductor placed in the centre of the inductor conducting heat to an external heat receiver and pressing the inductor and the central heat conductor towards the external heat receiver.
Figure 3:
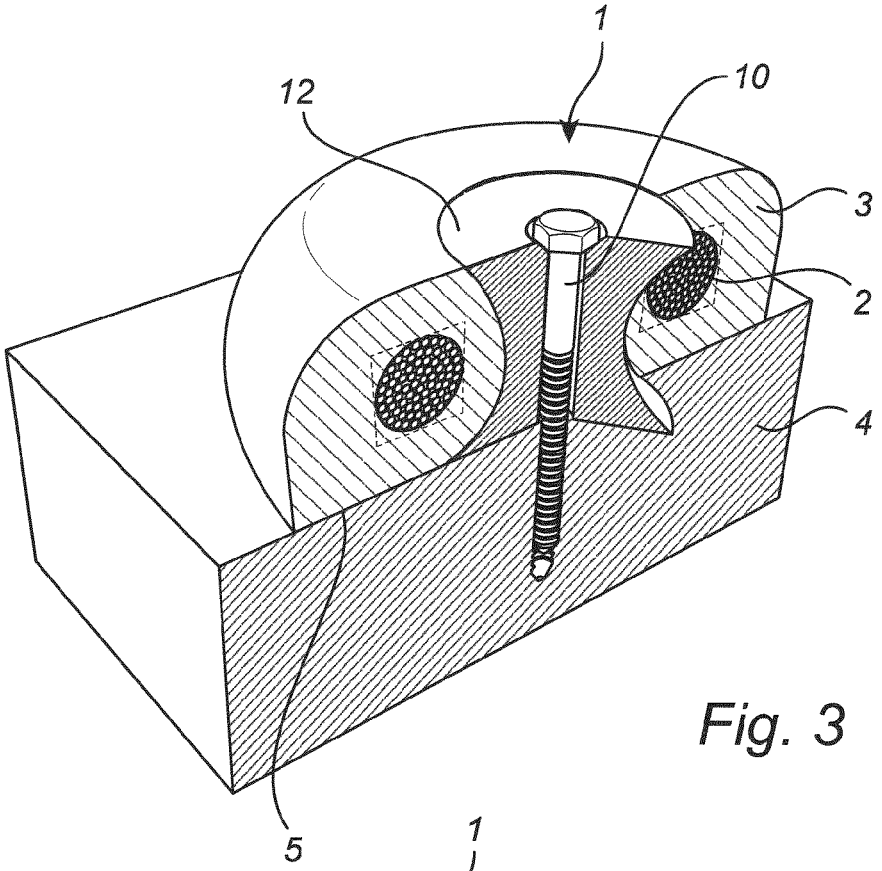
FIG. 3 is a cut out perspective view of an inductor and a the thermal connecting fixture according FIG. 2, wherein the central heat conductor of the thermal conductor is shaped after the direction of the magnetic field from the coil and thus has an hour glass shape.

Embodiment Two with Reference to FIG. 2 & FIG. 3

This invention also includes a second embodiment which leads to even more efficient cooling properties, enabling the design of inductor units 1 with even higher energy content and/or, depending on technical requirements, higher efficiency of the inductor. All elements previously described in embodiment one are applicable for this second embodiment.

The second embodiment further includes the integration or moulding of a highly thermally conductive thermally connecting fixture 11, which does not cause, or causes negligible, induction heating effects. This could be either a non-magnetic material or a magnetic material with low electrical conductivity. The integration or moulding of a heat conductor into the core 3 material substantially enhances the heat transferring capacity compared to using only the SMC core material. This can be realized by placing a centrum highly thermally conductive rod 11, acting as a thermally connecting fixture, in the centrum of the mould before moulding the inductor. The core material is then moulded around both the coil 2 and the rod 11 (see FIGS. 2 and 3). This rod is subsequently connected mechanically to an external heat receiver 4 where it acts as a heat conductor, conducting heat from the centrum part of the inductor, which is usually the hottest part of the inductor, to the external heat receiver.

The centrum rod 11 is optimally shaped so as to disrupt the flux path and core material as little as possible while maximizing the area to which the heat can be conducted through, preferably shaped in an hour glass shape (see FIG. 3 and FIG. 7). The mounting of the inductor 1 can otherwise be in the same way as explained in embodiment one above, placing a first thermal connecting fixture, i.e. a mounting screw, through a second thermal connecting fixture, i.e. the integrated or moulded rod.

Figure 4B:
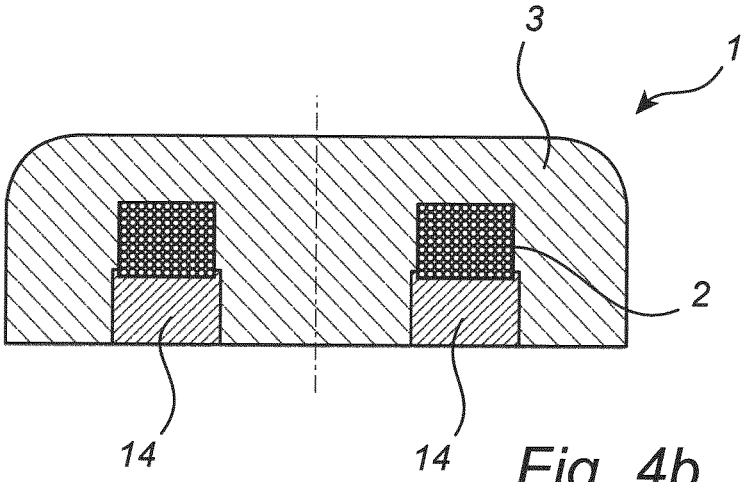

Embodiment Three with Reference to FIG. 4 & FIG. 5

This invention also includes a third embodiment which leads to even more efficient cooling properties, enabling the design of inductor units with even higher energy content and/or, depending on technical requirements, higher efficiency of the inductor. All elements previously described in embodiment one are applicable for this third embodiment.

This third embodiment further includes the integration or moulding of one or more thermal connecting fixtures 13-17 to be placed directly against the coil 2 at certain points in the inductor (see FIGS. 4*a*, 4*b*, 5*a*-5*c*). These thermal connecting fixtures can be made with any, non-magnetic, highly thermally conductive material, as explained in embodiment two, having substantially better thermal conductivity than the SMC based core materials, preferably aluminum or aluminum oxide. This will substantially enhance the heat transferring capacity of the inductor 1 compared to using only SMC materials or soft magnetic mouldable materials as core material. This can be realized by placing the thermal connecting fixture/s 13-17 into the mould before placing the coil into the mould and then moulding all within the inductor's structure.

It is furthermore important that these thermal connecting fixtures 13-17 are thin in the tangential direction so as to distort the magnetic flux path as little as possible while securing sufficient thermal connection to the coil 2 (see FIGS. 4*a*, 4*b*, 5*a*-5*c*). Due to their higher thermal conductivity these thermal connecting fixtures 13, 14 will act as the main heat transferring points within the inductor's structure towards an external heat receiver while the core material acts as a secondary thermal conductor. It is therefore important that both all thermal connecting fixtures 13-17 and the core material bottom surface 5 are in direct connection with the external heat receiver 4 so as to conduct heat from the inductor 1 to said first external heat receiver 4. This especially applies to the thermal connecting fixtures 13-17. The mounting of the inductor 1 can otherwise be in the same way as explained in embodiment one above.

Alternatively, according to this embodiment, the thermal connecting fixtures 13-17 described above can be integrated parts of a single, larger, planar, thermal connecting fixture i.e. a bottom mounting plate, later to be placed directly on an external heat receiver (see FIG. 5*c*). The mounting plate can also be integrated with the external heat receiver. During production this integrated thermal connecting fixture 13-17 would be placed in the mould before placing the coil into the mould and before moulding the inductor (see FIGS. 4*a*, 4*b*, 5*a*-5*c*). This alternative secures a larger connecting surface between the thermal conductive fixture and the external heat receiver compared to the first alternative. Moulding directly on the planar thermal connecting fixture also secures the maximum thermal connection between the core material and the thermal connecting fixture. The mounting of the inductor can otherwise be in the same way as explained in embodiment one above.

The thermal connecting fixtures 13-17 according to this third embodiment can also have the attractive technical benefit of becoming the coil's mounting fixtures within the mould to secure its precise position within the inductor's 1 structure. Positioning a coil 2 correctly can have significant effect on the inductor's 1 performance and tolerances. This presents a technical challenge when producing SMC inductors and requires otherwise a separate production step.

Embodiment Four, with Reference to FIG. 6 & FIG. 7

This invention also includes a fourth embodiment which leads to even more efficient cooling properties, enabling the design of inductor units with even higher energy content and/or, depending on technical requirements, higher efficiency of the inductor 1. All elements previously described in embodiment one are applicable for this fourth embodiment.

This embodiment further includes an adjustment of also the top surface area 6 of the inductor in an analogous way as described under embodiment one where the, at least one, thermally connecting fixture 11-21 is adapted to be connected to both a first 4 and second 5 external heat receiver so as to conduct heat from the inductor 1 to said first 4 and second 5 external heat receivers.

It is further a part of this embodiment that the inductor's connecting cables 7 are taken out from the circular side of the inductor enabling the direct thermal connection 18 from both top and bottom side of the inductor.

The two external heat receivers 4, 5 can also be used as the mounting fixtures for the inductor 1. In such cases the pressure needed to secure the direct thermal coupling between the inductor's complete surfaces and the two external heat receivers may also be achieved with other mechanical methods than described under embodiment one, pressing the inductor between the two external heat receivers. Optimally, the mounting as described under embodiment one can be used connecting the thermal connecting fixture i.e. mounting screw 10 to both heat receivers.

To secure even further the heat conductivity between the inductor 1 and the heat sinking body a heat transferring paste can be placed in between. An additional benefit with such an addition is to reduce or remove vibrations created from the alternating current in the inductor 1. The heat sinking bodies can be either air or liquid cooled.

Depending on the energy content, cooling need of the inductor 1 and/or required efficiency level it is also possible to introduce thermal connecting fixtures 11-21 as explained in embodiments two or three which are accordingly connected to both heat receivers (see FIGS. 6-7*d*).

Depending on the energy content, cooling need of the inductor 1 or required efficiency level, the connecting cables 7 can also be connected to an external heat receiver close to their entry into the inductor. This is especially attractive when the inductor has few turns i.e. low inductance compared to its energy content. This external heat receiver can easily be connected to the same external heat receiver/s as described in embodiment one and four.

Embodiment Five, with Reference to FIG. 8 & FIG. 9

This invention also includes a fifth embodiment which leads to even more efficient cooling properties, enabling the design of inductor units with even higher energy content and/or, depending on technical requirements, higher efficiency of the inductor 1.

This fifth embodiment also requires the use of a soft magnetic mouldable material, embedding the annularly wound coil completely in the core 3 material which has thermal conductivity above 1.5 W/m*K more preferable above 2 W/m*K, most preferable above 3 W/m*K, creating a direct thermal coupling between the coil 2 and core material 3, the core material acting as a thermal conductor conducting heat from said coil 2.

This embodiment further includes creating a surface or cavity 22 on a highly thermally conductive material which does not cause, or causes negligible, induction heating effects. This could be either a non-magnetic material or a magnetic material with low electrical conductivity.

The surface or cavity is meant to be an integral part of a further technical product 22 (see FIGS. 8-9*b*). The inductor 1 is then moulded directly onto/into the surface or cavity making the further technical product a thermally connecting fixture for the inductor. The surface or cavity could also include thermal connecting fixtures 23 as explained in embodiments two and three (see 9*a* and 9*b*).

The surface or cavity within further technical product serves in this case three important technical purposes.

Firstly, the surface or cavity 22 within the further technical product acts as a thermal connecting fixture in direct thermal connection with the inductor's core 3 material as it is moulded directly onto/into the further technical product 22. It therefore has thermal contact with at least one surface (as with a planar surface), preferably from all sides but one (as when moulded into a cavity). These thermally connecting fixtures 22, 23 are usually mechanically connected to an external structure which can act as external heat receiver. This thermally connecting fixture 22, 23 can also act as external heat receiver by itself. When these thermal connecting fixtures also act as external heat receivers they do so by increasing the inductor's heat radiating surface which can either be liquid or air cooled.

Secondly, in the case of thermally connecting fixture 22, 23 which is shape into a cavity the cavity becomes the final mould for the inductor 1 removing time-consuming and expensive production steps and mould handling. If protruding thermal connecting fixtures 23 are present, they further also serve to hold the coil in place during moulding at the same time as a tight connection between the coil and the thermal connecting fixtures 23 are facilitated.

Thirdly, these thermally connecting fixtures 22, 23 secure a strong mechanic structure and remove the need for mechanically mounting the inductor 1 on e.g. a separate mounting plate.

Embodiment Six, with Reference to FIG. 10

This invention also includes a sixth embodiment which leads to even more efficient cooling properties, enabling the design of inductor units with even higher energy content and/or, depending on technical requirements, higher efficiency of the inductor 1.

This sixth embodiment also requires the use a soft magnetic mouldable material, embedding the annularly wound coil completely in the core material which has thermal conductivity above 1.5 W/m*K more preferable above 2 W/m*K, most preferable above 3 W/m*K, creating a direct thermal coupling between the coil 2 and core material, the core material 3 acting as a thermal conductor conducting heat from said coil 2.

This embodiment includes placing one or more cooling pipes 24, acting as thermally connecting fixtures 24, in the core, preferably very close to the coil 2. Optimally the cooling pipes 24 are flexible and toroidally wound around at least a part of the coil 2. The cooling pipes 24 are constructed to have a hollow space within their cross section enabling a liquid to run continually through them into an external heat receiver to effectively extract the heat generated by coil and core losses. The cooling pipes 24 are optimally extracted from the structure in the same place as the connecting cables 7 so as to affect the magnetic flux path as little as possible. As the cooling pipes are wound approximately in the same direction as the flux path, they will have minimal effect on the flux path and the inductive properties of the inductor unit 1. This inductor 1 is realized by correctly positioning the coil, after it has been toroid wound with the cooling pipes, into a mould. The soft magnetic mouldable material is thereafter placed in the mould, moulding the coil and cooling pipes into one single inductor unit.

Embodiment Seven, with Reference to FIG. 11

This invention also includes a seventh embodiment which leads to even more efficient cooling properties, enabling the design of inductor units with even higher energy content and/or, depending on technical requirements, higher efficiency of the inductor 1.

This seventh embodiment also requires the use a soft magnetic mouldable material, embedding the annularly wound coil completely in the core material which has thermal conductivity above 1.5 W/m*K more preferable above 2 W/m*K, most preferable above 3 W/m*K, creating a direct thermal coupling between the coil 2 and core material 3, the core material 3 acting as a thermal conductor conducting heat from said coil 2.

Once certain energy content is reached, the H-field strength also starts becoming a problem and saturates the core material resulting in a drop in the inductor's 1 inductance and increased losses. This is because while the circumference of the coil 2 increases linearly with the coil's radius, the current carrying area increases with the square. When such high energy content is reached in an inductor 1 t is also challenging to cool away the losses generated in the centre of the coil 2. A solution which solves both these challenges is introducing cavities inside the coil 2 which reduce the H-fields intensity. These cavities are optimally created by integrating one or more cooling pipes 25 in the tangential direction of the coil 2, the pipes 25 acting as thermal connecting fixtures, inside the centre of the coil's cross section (see FIG. 11). The cooling pipes 25 are constructed to have a hollow space within their cross section enabling a liquid to run continually through them and into an external heat receiver to effectively extract the heat generated by the coil losses. These cooling pipes 25 can be made from polymer material or thin stainless steel tubes. Alternatively copper tubes can be used reaching the same effect.

List of Embodiments

1. An inductor (1) having a coil (2) and a core (3), wherein the core (3) is made of a Soft Magnetic Composite (SMC), the coil (2) is composed of a annularly wound electrical conductor, the coil (2) is substantially integrated into said core (3) so that the core (3) material acts as a thermal conductor having thermal conductivity above 1.5 W/m*K more preferably 2 W/m*K most preferably 3 W/m*K, conducting heat from said coil (2), wherein the inductor (1) is in thermal connection with at least one thermal connecting fixture (10-25), wherein said at least one thermal connecting fixture (10-25) is adapted to be connected to a first external heat receiver (4) so as to conduct heat from the inductor to said first external heat receiver (4).

2. An inductor (1) according to embodiment 1, wherein said at least one thermal connecting fixture (10-17, 19-25) is moulded into said core (3).

3. An inductor (1) according to any one of the preceding embodiments, wherein said core (3) has a shape that is adapted to enlarge the thermal connection surface (5) between at least the bottom side of the inductor (1) and adjusted to be placed on a flat surface of a heat receiver (4), wherein the diameter of the inductor (1) is approximately at least two times the height.

4. An inductor (1) according to any one of embodiment 1-3, wherein the thermal connecting fixture (10-12) is or has a centrally detachable mounted screw/rod (10) protruding through the center of the inductor (1) along a central axis of the inductor (1).

5. An inductor (1) according to embodiment 1-4, wherein the thermal connecting fixture (13) is shaped after the magnetic field along the central axis of the inductor (1).

6. An inductor (1) according to any one of embodiment 1-2, wherein said at least one thermal connecting fixture (10-17, 19-25) is integrated in said core (3), being in thermal connection to said coil (2).

7. An inductor (1) according to embodiment 6, having multiple thermal connecting fixtures (13-17, 20, 21, 23, 24) at evenly spaced positions annular around said coil (2).

8. An inductor (1) according to embodiment 7, wherein said thermal connecting fixtures (13-17, 20, 21, 23, 24) are thin in the tangential direction of the coil (2) so as to present a small cross section to the magnetic field of said coil (2).

9. An inductor (1) according to any one of the preceding embodiments, wherein said thermal connecting fixture (10-17, 19-23) is adapted to be attached to said first external heat receiver (4) and thereby press the inductor (1) against said first external heat receiver (4).

10. An inductor (1) according to any one of embodiments 6-10, wherein said thermal connecting fixtures (17, 22) are integral parts of said first external heat receiver (4), said heat receiver being an external heat sink or a cooling/mounting plate.

11. An inductor (1) according to any one of the preceding embodiments, wherein at least one of the connector cables (7) of the inductor (1) are cooled adjacent to their entry into the core (3) material by thermal connection (18) of a cooling device.

12. An inductor (1) according to embodiments 1 or 2, wherein the core (3) has at least one integrated cooling pipe (24) wherein said cooling pipe/pipes (24) are in thermal connection with said coil (2) and said cooling pipe/pipes (24) are adapted to accommodate a flow of a fluid for transporting heat from said coil (2).

13. An inductor (1) according to embodiment 12, wherein said cooling pipes (24) are wound in a spiral toroid shape around said annularly wound coil (2).

14. An inductor (1) according to embodiment 1 or 2, wherein said coil (2) has at least one integrated cooling pipe (25) said cooling pipe/pipes (25) being placed within the coil (2) cross section.

15. An inductor (1) according to any one of the preceding embodiments 1-11, wherein the core (3) has a shape that is adapted to enlarge the thermal connection surface (6) between the upper sides of the inductor (1) and a surface of a second external heat receiver (5), wherein the thermal connecting fixtures (10-25) may be thermally connected to said second external heat receiver (5) in analogous ways as to the first external heat receiver (4) according to embodiments 1-11.

16 The inductor (1) according to embodiment 14 or 15, wherein the connector cables of the inductor (1) exit the core (3) on the side, so as to not interfere with heat receivers attached to the upper (6) and bottom (5) sides of the inductor.

17. The inductor (1) according to any one of the preceding embodiments, wherein the thermally connecting fixture is an integral part of said external heat receiver or attached to said external heat receiver, and said thermally connecting fixture (22, 23) is or is a part of a surface or cavity of a further technical product, wherein the core (3) is moulded onto or into said surface or cavity.

18. The inductor (1) according to any one of embodiments 6-10 or 17, wherein said thermal connecting fixtures (13-17, 20, 21, 23) are adapted to position said coil (2) during moulding of said core (3).

19. Use of an inductor (1) according to any one of the preceding embodiments, wherein the inductor (1) is a choke for a switching frequency above 2 kHz, more preferably above 4 kHz, most preferably above 6 kHz, used at a energy contents above 0.2 J 20. Use of an inductor (1) according to any one of the preceding embodiments, wherein the inductor (1) is used at a current above 25 Arms.

The invention claimed is:

1. An inductor comprising:

a coil; and a core;

wherein the core is made of a Soft Magnetic Composite (SMC);

wherein the coil is an annularly wound electrical wire;

wherein the coil is integrated into the core so that the core material acts as a thermal conductor having thermal conductivity above 1.5 W/m*K, conducting heat from the coil;

wherein the inductor is in thermal connection with at least one thermal connecting fixture;

wherein the at least one thermal connecting fixture is adapted to be connected to a first external heat receiver so as to conduct heat from the inductor to the first external heat receiver;

wherein the core has at least one integrated cooling pipe in thermal connection with the coil, and the at least one cooling pipe being adapted to accommodate a flow of a fluid for transporting heat from the coil; and wherein the at least one cooling pipe is wound in a spiral toroid shape around the annularly wound coil.

2. The inductor according to claim 1, wherein at least one connector cable of the inductor is cooled adjacent to a connector cable entry into the core material by thermal connection of a cooling device.

3. The inductor according to claim 1, wherein the core is shaped to enlarge a thermal connection surface between an upper side of the inductor and a surface of a second external heat receiver;

wherein the at least one thermal connecting fixture is thermally connected to the second external heat receiver; and wherein the at least one thermal connecting fixture includes a centrally detachable mounted screw or rod extending through the center of the inductor along a central axis of the inductor.

4. The inductor according to claim 1, wherein the at least one thermally connecting fixture is an integral part of the first external heat receiver or attached to the first external heat receiver;

wherein the at least one thermally connecting fixture is a part of a cavity of a technical system; and wherein the core is moulded onto or into the cavity.

5. The inductor according to claim 4, wherein the at least one thermal connecting fixture is adapted to position the coil during moulding of the core.

6. The inductor according to claim 1, wherein the inductor is a choke for a switching frequency above 2 kHz; and wherein the inductor is used at an energy contents above 0.2 J.

7. The inductor according to claim 1, wherein the inductor is used at a current above 25 A (rms).

* * * * *